US008528635B2

(12) United States Patent
Harrison et al.

(10) Patent No.: US 8,528,635 B2
(45) Date of Patent: Sep. 10, 2013

(54) TOOL TO DETERMINE FORMATION FLUID MOVEMENT

(75) Inventors: Allen Ray Harrison, Houston, TX (US); Edward Harrigan, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 511 days.

(21) Appl. No.: 12/779,309

(22) Filed: May 13, 2010

(65) Prior Publication Data

US 2011/0277997 A1 Nov. 17, 2011

(51) Int. Cl.
*E21B 47/09* (2012.01)

(52) U.S. Cl.
USPC ..... 166/250.12; 166/254.1; 166/305.1

(58) Field of Classification Search
USPC ..... 166/264, 250.17, 254.1, 252.6, 250.02, 166/250.12, 305.1, 191
See application file for complete search history.

(56) References Cited

U.S. PATENT DOCUMENTS 2,564,198 A * 8/1951 Elkins ..... 73/152.18
2,658,725 A * 11/1953 Arps ..... 175/41
3,817,328 A * 6/1974 Neuman ..... 376/166
6,275,645 B1 * 8/2001 Vereecken et al. ..... 385/147
6,301,959 B1 * 10/2001 Hrametz et al. ..... 73/152.23
6,641,434 B2 11/2003 Boyle et al.
6,761,062 B2 * 7/2004 Shapiro ..... 73/152.41
6,877,559 B2 * 4/2005 Hashem ..... 166/264
6,964,301 B2 * 11/2005 Hill et al. ..... 166/264
6,986,282 B2 1/2006 Ciglenec et al.
7,114,562 B2 10/2006 Fisseler et al.
7,424,366 B2 9/2008 Angelescu et al.
7,866,387 B2 * 1/2011 van Zuilekom et al. ..... 166/265
8,191,416 B2 * 6/2012 Kuchuk et al. ..... 73/152.41
2003/0056952 A1 * 3/2003 Stegemeier et al. ..... 166/250.12

* cited by examiner

*Primary Examiner* — Kenneth L Thompson
(74) *Attorney, Agent, or Firm* — Cathy Hewitt; John Vereb

(57) ABSTRACT

The present disclosure relates to one or more apparatuses and methods to determine fluid movement within a formation. The apparatus includes a first packer configured to selectively engage a wall of a borehole of the formation, an outlet disposed adjacent to the first packer, wherein the outlet is configured to pump a first fluid therefrom and into the formation, and a detecting tool configured to detect the first fluid within the formation. Movement of the first fluid may be determined based upon the detection of the first fluid within the formation.

19 Claims, 8 Drawing Sheets

TOOL TO DETERMINE FORMATION FLUID MOVEMENT

BACKGROUND OF THE DISCLOSURE

Wells are generally drilled into the ground or ocean bed to recover natural deposits of oil and gas, as well as other desirable materials that are trapped in geological formations in the Earth's crust. Wells are typically drilled using a drill bit attached to the lower end of a "drill string." Drilling fluid, or mud, is typically pumped down through the drill string to the drill bit. The drilling fluid lubricates and cools the bit, and may additionally carry drill cuttings from the borehole back to the surface.

In various oil and gas exploration operations, it may be beneficial to have information about the subsurface formations that are penetrated by a borehole. For example, certain formation evaluation schemes include measurement and analysis of the formation pressure and permeability. These measurements may be essential to predicting the production capacity and production lifetime of the subsurface formation.

Reservoir well production and testing may involve drilling into the subsurface formation and the monitoring of various subsurface formation parameters. When drilling and monitoring, downhole tools having electric, mechanic, and/or hydraulic powered devices may be used. In some implementations, pump systems may be used to draw and pump formation fluid from subsurface formations. A downhole string (e.g., a drill string, coiled tubing, slickline, wireline, etc.) may include one or more pump systems depending on the operations to be performed using the downhole string, or the string may have fluids pumped therein from a surface of the formation.

In a downhole flow analysis environment, the naturally occurring hydrocarbon fluids may include dry natural gas, wet gas, condensate, light oil, black oil, heavy oil, and heavy viscous tar. In addition, water and synthetic fluids, such as oils used within drilling muds, and fluids used in formation fracturing jobs, may also be present within the downhole environment.

As the economic value of a hydrocarbon reserve, the method of production, the efficiency of recovery, the design of production equipment, in addition to a number of other factors, all depend upon a number of flow parameters, such as physical properties, phase behavior and flow rates of the fluid, it is important that the flow parameters be determined accurately. As such, it may be valuable to determine the movement of fluid when present within a formation, for example, to assist in determining the value of a hydrocarbon reserve and formation, or at least a portion thereof.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
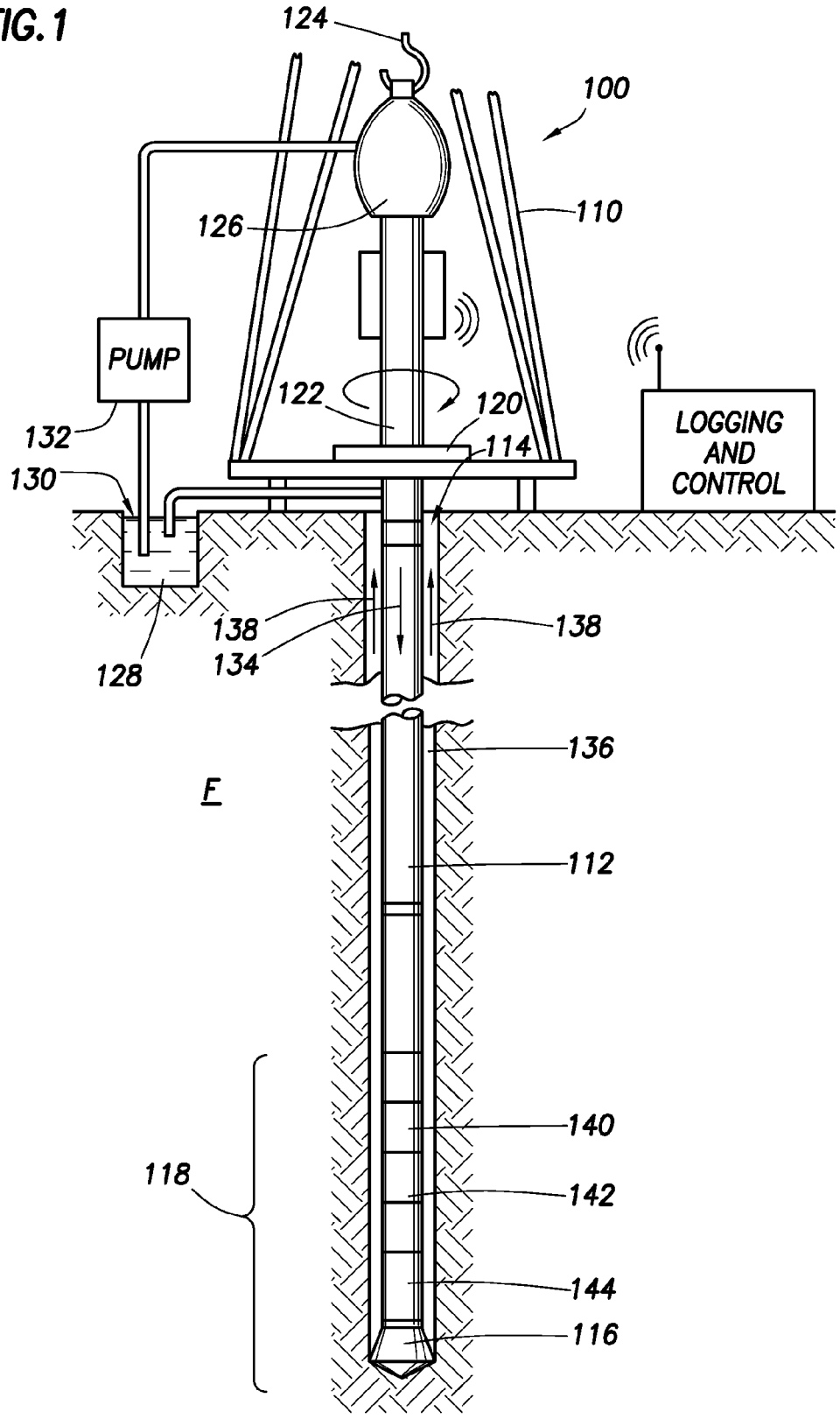
FIG. 1 is a side view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, by forming a first feature over or on a second feature in the description that follows may include embodiments in which the first and second features are formed in direct contact, and may also include embodiments in which additional features may be formed interposing the first and second features, such that the first and second features may not be in direct contact.

Referring now to FIG. 1, illustrated is a side view of a wellsite 100 having a drilling rig 110 with a drill string 112 suspended therefrom in accordance with one or more aspects of the present disclosure. The wellsite 100 shown, or one similar thereto, may be used within onshore and/or offshore locations. As shown, a borehole 114 may be formed within a subsurface formation F, such as by using rotary drilling, or any other method known in the art. As such, aspects of the present disclosure may be used within a wellsite, similar to the one as shown in FIG. 1 (discussed more below). Those having ordinary skill in the art will appreciate that the present disclosure may be used within other wellsites or drilling operations, such as within a directional drilling application, without departing from the scope of the present disclosure.

Continuing with FIG. 1, the drill string 112 may suspend from the drilling rig 110 into the borehole 114. The drill string 112 may include a bottom hole assembly 118 and a drill bit 116, in which the drill bit 116 may be disposed at an end of the drill string 112. The surface of the wellsite 100 may have the drilling rig 110 positioned over the borehole 114, and the drilling rig 110 may include a rotary table 120, a kelly 122, a traveling block or hook 124, and may additionally include a rotary swivel 126. The rotary swivel 126 may be suspended from the drilling rig 110 through the hook 124, and the kelly 122 may be connected to the rotary swivel 126 such that the kelly 122 may rotate with respect to the rotary swivel.

An upper end of the drill string 112 may be connected to the kelly 122, such as by threadingly connecting the drill string 112 to the kelly 122, and the rotary table 120 may rotate the kelly 122, thereby rotating the drill string 112 connected thereto. As such, the drill string 112 may be able to rotate with respect to the hook 124. Those having ordinary skill in the art, however, will appreciate that though a rotary drilling system is shown in FIG. 1, other drilling systems may be used without departing from the scope of the present disclosure. For example, a top-drive (also known as a "power swivel") system may be used in accordance with the present disclosure. In such a top-drive system, the hook 124, swivel 126, and kelly 122 are replaced by a drive motor (electric or hydraulic) that may apply rotary torque and axial load directly to drill string 112.

The wellsite 100 may further include drilling fluid 128 (also known as drilling "mud") stored in a pit 130. The pit 130 may be formed adjacent to the wellsite 100, as shown, in which a pump 132 may be used to pump the drilling fluid 128 into the wellbore 114. The pump 132 may pump and deliver the drilling fluid 128 into and through a port of the rotary swivel 126, thereby enabling the drilling fluid 128 to flow into and downwardly through the drill string 112, the flow of the drilling fluid 128 indicated generally by direction arrow 134. This drilling fluid 128 may then exit the drill string 112 through one or more ports disposed within and/or fluidly connected to the drill string 112. For example, the drilling fluid 128 may exit the drill string 112 through one or more ports formed within the drill bit 116.

The drilling fluid 128 may flow back upwardly through the borehole 114, such as through an annulus 136 formed between the exterior of the drill string 112 and the interior of the borehole 114, the flow of the drilling fluid 128 indicated generally by direction arrow 138. With the drilling fluid 128 following the flow pattern of direction arrows 134 and 138, the drilling fluid 128 may be able to lubricate the drill string 112 and the drill bit 116, and/or may be able to carry formation cuttings formed by the drill bit 116 (or formed by any other drilling components disposed within the borehole 114) back to the surface of the wellsite 100. This drilling fluid 128 may be filtered and cleaned and/or returned back to the pit 130 for recirculation within the borehole 114.

Though not shown, the drill string 112 may include one or more stabilizing collars. A stabilizing collar may be disposed within and/or connected to the drill string 112, in which the stabilizing collar may be used to engage and apply a force against the wall of the borehole 114. This may enable the stabilizing collar to prevent the drill string 112 from deviating from the desired direction for the borehole 114. For example, during drilling, the drill string 112 may "wobble" within the borehole 114, thereby enabling the drill string 112 to deviate from the desired direction of the borehole 114. This wobble may also be detrimental to the drill string 112, components disposed therein, and the drill bit 116 connected thereto. However, a stabilizing collar may be used to minimize, if not overcome altogether, the wobble action of the drill string 112, thereby possibly increasing the efficiency of the drilling performed at the wellsite 100 and/or increasing the overall life of the components at the wellsite 100.

As discussed above, the drill string 112 may include a bottom hole assembly 118, such as by having the bottom hole assembly 118 disposed adjacent to the drill bit 116 within the drill string 112. The bottom hole assembly 118 may include one or more components included therein, such as components to measure, process, and store information. The bottom hole assembly 118 may include components to communicate and relay information to the surface of the wellsite.

In FIG. 1, the bottom hole assembly 118 may include one or more logging-while-drilling ("LWD") tools 140 and/or one or more measuring-while-drilling ("MWD") tools 142. The bottom hole assembly 118 may also include a steering-while-drilling system (e.g., a rotary-steerable system) and motor 144, in which the rotary-steerable system and motor 144 may be coupled to the drill bit 116.

The LWD tool 140 shown in FIG. 1 may include a thick-walled housing, commonly referred to as a drill collar, and may include one or more of a number of logging tools known in the art. Thus, the LWD tool 140 may be capable of measuring, processing, and/or storing information therein, as well as capabilities for communicating with equipment disposed at the surface of the wellsite 100.

The MWD tool 142 may also include a housing (e.g., drill collar), and may include one or more of a number of measuring tools known in the art, such as tools used to measure characteristics of the drill string 112 and/or the drill bit 116. The MWD tool 142 may also include an apparatus for generating and distributing power within the bottom hole assembly 118. For example, a mud turbine generator powered by flowing drilling fluid therethrough may be disposed within the MWD tool 142. Alternatively, other power generating sources and/or power storing sources (e.g., a battery) may be disposed within the MWD tool 142 to provide power within the bottom hole assembly 118. The MWD tool 142 may include one or more of the following measuring tools: a weight-on-bit measuring device, a torque measuring device, a vibration measuring device, a shock measuring device, a stick slip measuring device, a direction measuring device, an inclination measuring device, and/or any other device known in the art used within an MWD tool.

Figure 2:
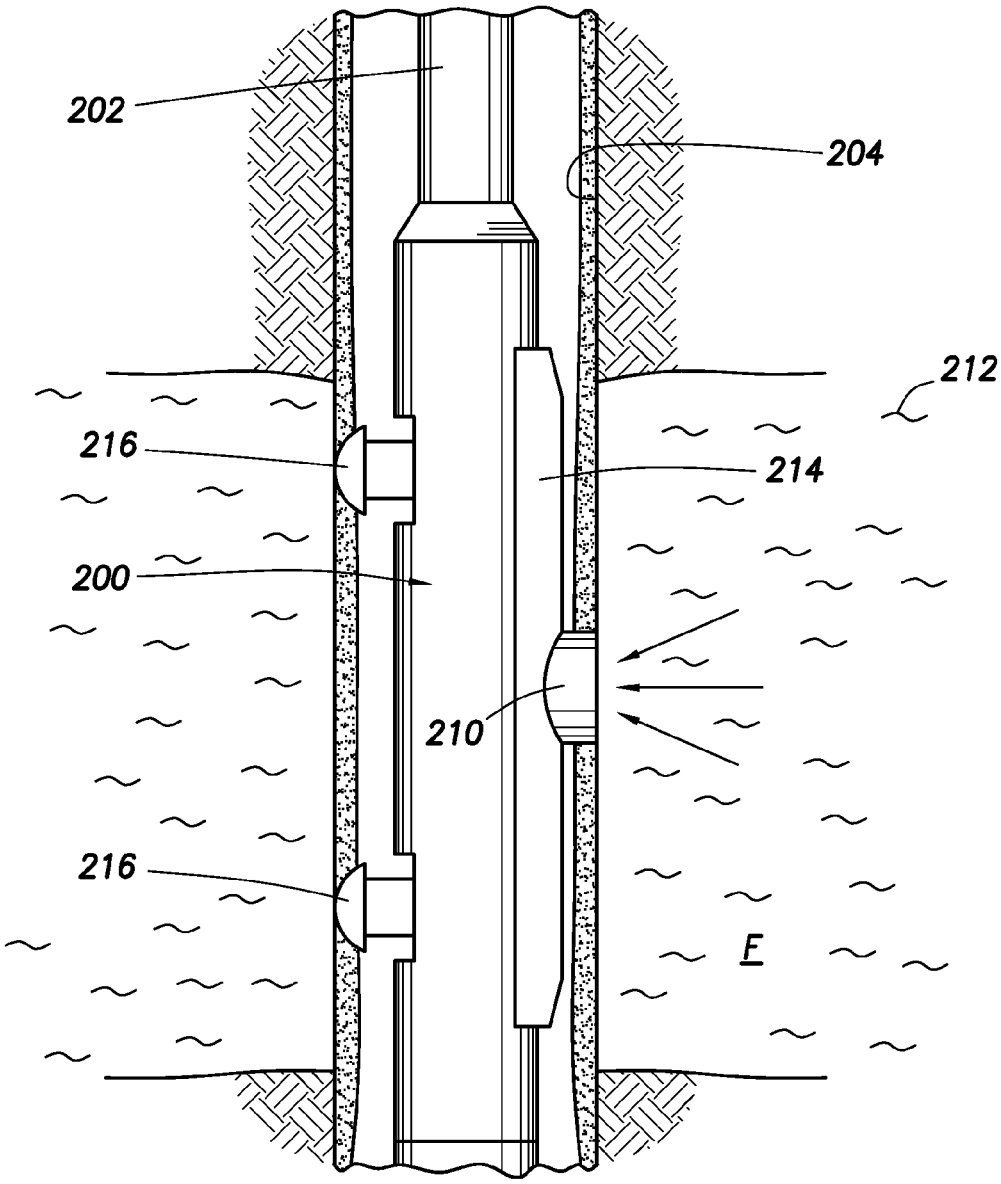
FIG. 2 is a side view of apparatus according to one or more aspects of the present disclosure.

Referring now to FIG. 2, illustrated is a side view of a tool 200 in accordance with one or more aspects of the present disclosure. The tool 200 may be connected to and/or included within a drill string 202, in which the tool 200 may be disposed within a borehole 204 formed within a subsurface formation F. As such, the tool 200 may be included and used within a bottom hole assembly, as described above.

Particularly, the tool 200 may include a sampling-while drilling ("SWD") tool, such as that described within U.S. Pat. No. 7,114,562, filed on Nov. 24, 2003, entitled "Apparatus and Method for Acquiring Information While Drilling," and incorporated herein by reference in its entirety. The tool 200 may include a probe 210 to hydraulically establish communication with the formation F and draw formation fluid 212 into the tool 200.

The tool 200 may also include a stabilizer blade 214 and/or one or more pistons 216. The probe 210 may be disposed on the stabilizer blade 214 and extend therefrom to engage the wall of the borehole 204. The pistons, if present, may also extend from the tool 200 to assist probe 210 in engaging with the wall of the borehole 204. In alternative configurations, though, the probe 210 may not necessarily engage the wall of the borehole 204 when drawing fluid.

Fluid 212 drawn into the tool 200 may be measured to determine one or more parameters of the formation F, such as pressure and/or pretest parameters of the formation F. Additionally, the tool 200 may include one or more devices, such as sample chambers or sample bottles, that may be used to collect formation fluid samples. These formation fluid samples may be retrieved back at the surface with the tool 200. Alternatively, rather than collecting formation fluid samples, the formation fluid 212 received within the tool 200 may be circulated back out into the formation F and/or borehole 204. A pumping system may be included within the tool 200 to pump the formation fluid 212 circulating within the tool 200. For example, the pumping system may be used to pump formation fluid 212 from the probe 210 to the sample bottles and/or back into the formation F. Alternatively still, rather than collecting formation fluid samples, a tool in accordance with the present disclosure may be used to collect samples from the formation F, such as one or more coring samples from the wall of the borehole 204.

Figure 3:
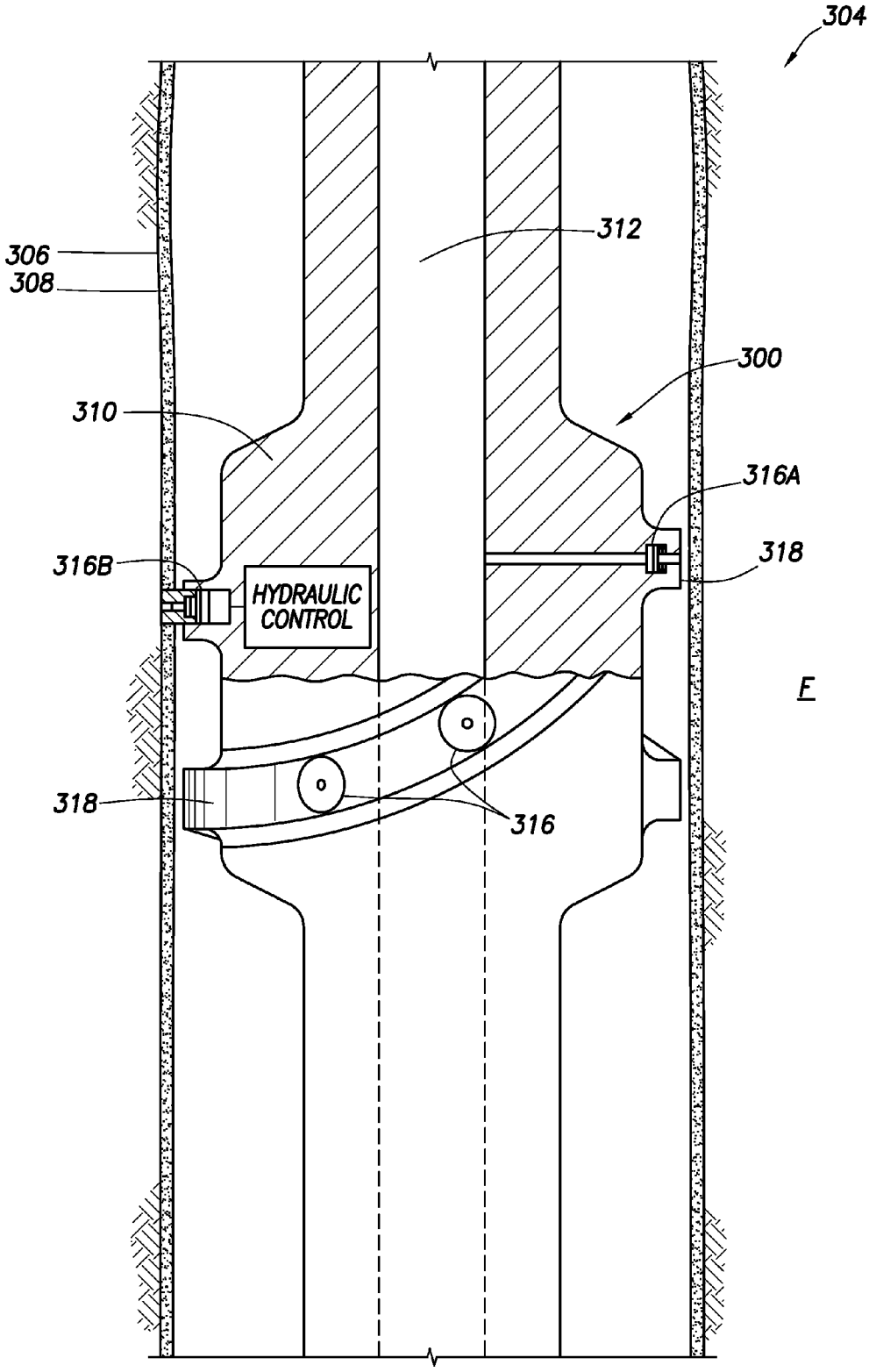
FIG. 3 is a schematic view of apparatus according to one or more aspects of the present disclosure.

Referring now to FIG. 3, illustrated is a schematic view of a tool 300 in accordance with one or more aspects of the present disclosure. The tool 300 may be connected to and/or included within a bottom hole assembly, in which the tool 300 may be disposed within a borehole 304 formed within a subsurface formation F.

The tool 300 may be a pressure LWD tool used to measure one or more downhole pressures, including annular pressure, formation pressure, and pore pressure, before, during, and/or after a drilling operation. Those having ordinary skill in the art will appreciate that other pressure LWD tools may also be utilized in accordance with the present disclosure, such as that described within U.S. Pat. No. 6,986,282, filed on Feb. 18, 2003, entitled "Method and Apparatus for Determining Downhole Pressures During a Drilling Operation," and incorporated herein by reference.

As shown, the tool 300 may be formed as a modified stabilizer collar 310, similar to a stabilizer collar as described above, and may have a passage 312 formed therethrough for drilling fluid. The flow of the drilling fluid through the tool 300 may create an internal pressure $P_1$, and the exterior of the tool 300 may be exposed to an annular pressure $P_A$ of the surrounding borehole 304 and formation F. A differential pressure $P_\delta$ formed between the internal pressure $P_1$ and the annular pressure $P_A$ may then be used to activate one or more pressure devices 316 included within the tool 300.

The tool 300 may include two pressure measuring devices 316A and 316B that may be disposed on stabilizer blades 318 formed on the stabilizer collar 310. The pressure measuring device 316A may be used to measure the annular pressure $P_A$ in the borehole 304, and/or may be used to measure the pressure of the formation F when positioned in engagement with a wall 306 of the borehole 304. As shown in FIG. 3, the pressure measuring device 316A is not in engagement with the borehole wall 306, thereby enabling the pressure measuring device 316A to measure the annular pressure $P_A$, if desired. However, when the pressure measuring device 316A is moved into engagement with the borehole wall 306, the pressure measuring device 316A may be used to measure pore pressure of the formation F.

As also shown in FIG. 3, the pressure measuring device 316B may be extendable from the stabilizer blade 318, such as by using a hydraulic control disposed within the tool 300. When extended from the stabilizer blade 318, the pressure measuring device 316B may establish sealing engagement with the wall 306 of the borehole 304 and/or a mudcake 308 of the borehole 304. This may enable the pressure measuring device 316B to take measurements of the formation F also. Other controllers and circuitry, not shown, may be used to couple the pressure measuring devices 316 and/or other components of the tool 300 to a processor and/or a controller. This processor and/or controller may then be used to communicate the measurements from the tool 300 to other tools within a bottom hole assembly or to the surface of a wellsite. A pumping system may be included within the tool 300, such as including the pumping system within one or more of the pressure devices 316 for activation and/or movement of the pressure devices 316.

Figure 4:
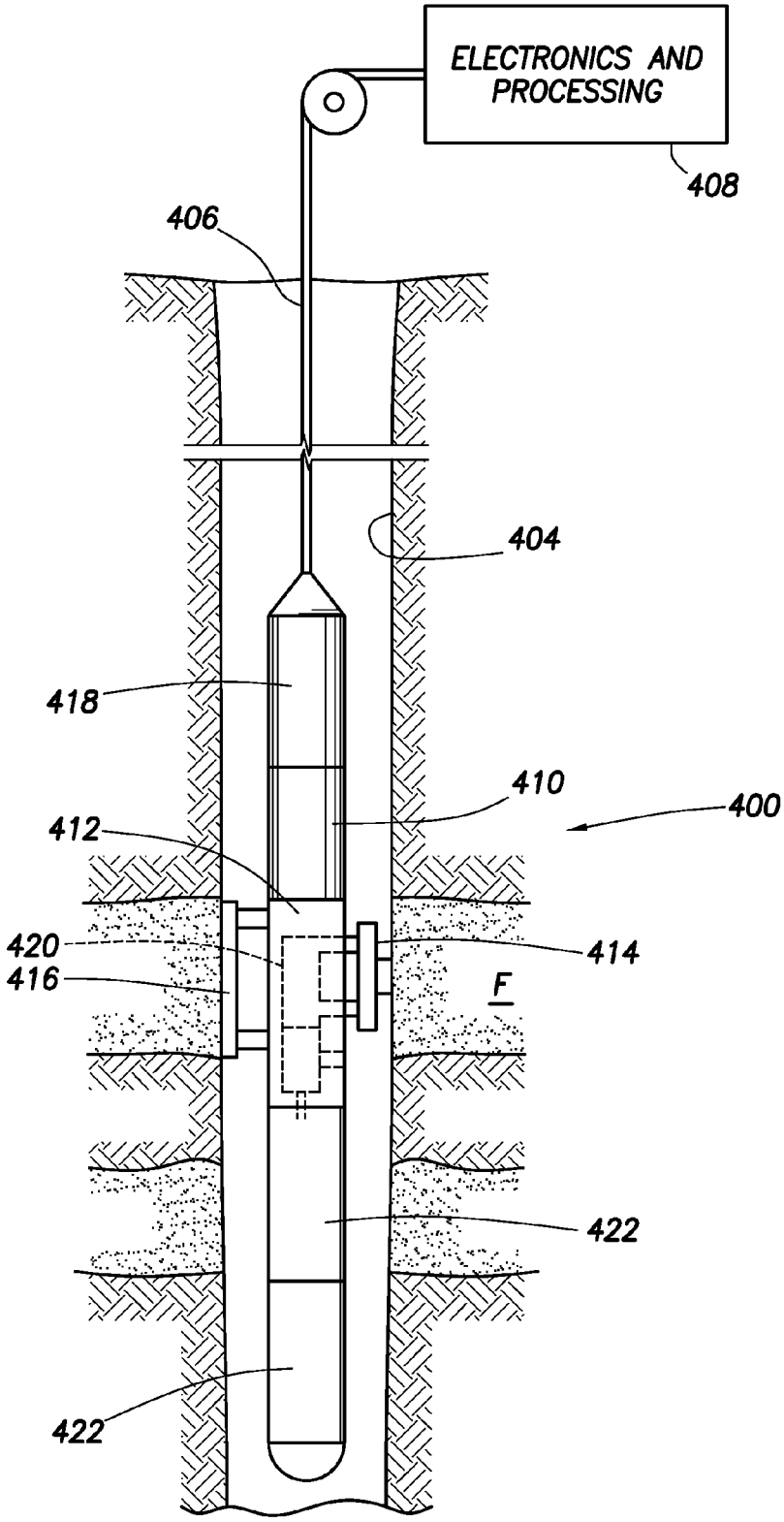
FIG. 4 is a side view of apparatus according to one or more aspects of the present disclosure.

Referring now to FIG. 4, illustrated is a side view of a tool 400 in accordance with one or more aspects of the present disclosure. As shown, the tool 400 may be a "wireline" tool, in which the tool 400 may be suspended within a borehole 404 formed within a subsurface formation F. The tool 400 may be suspended from an end of a multi-conductor cable 406 located at the surface of the formation F, such as by having the multi-conductor cable 406 spooled around a winch (not shown) disposed on the surface of the formation F. The multi-conductor cable 406 is then couples the tool 400 with an electronics and processing system 408 disposed on the surface.

The tool 400 may have an elongated body 410 that includes a formation tester 412 disposed therein. The formation tester 412 may include an extendable probe 414 and an extendable anchoring member 416, in which the probe 414 and anchoring member 416 may be disposed on opposite sides of the body 410. One or more other components 418, such as a measuring device, may also be included within the tool 400.

The probe 414 may be included within the tool 400 such that the probe 414 may be able to extend from the body 410 and then selectively seal off and/or isolate selected portions of the wall of the borehole 404. This may enable the probe 414 to establish pressure and/or fluid communication with the formation F to draw fluid samples from the formation F. The tool 400 may also include a fluid analysis tester 420 that is in fluid communication with the probe 414, thereby enabling the fluid analysis tester 420 to measure one or more properties of the fluid. The fluid from the probe 414 may also be sent to one or more sample chambers or bottles 422, which may receive and retain fluids obtained from the formation F for subsequent testing after being received at the surface. The fluid from the probe 414 may also be sent back out into the borehole 404 or formation F.

Figure 5:
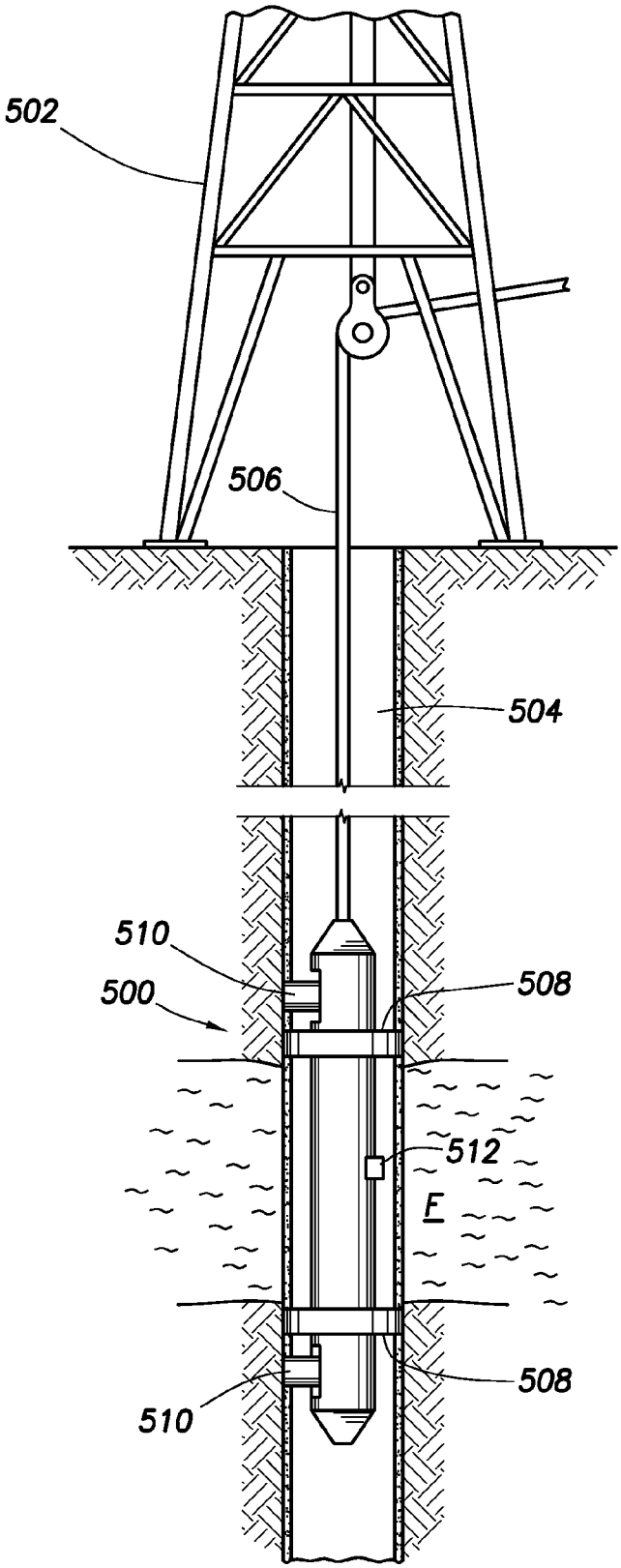
FIG. 5 is a side view of apparatus according to one or more aspects of the present disclosure.

Referring now to FIG. 5, illustrated is a side view of another tool 500 in accordance with one or more aspects of the present disclosure. Similar to FIG. 4, the tool 500 may be suspended within a borehole 504 formed within a subsurface formation F using a multi-conductor cable 506. The multi-conductor cable 506 may be supported by a drilling rig 502.

As shown, the tool 500 may include one or more packers 508 that may be configured to inflate, thereby selectively sealing off a portion of the borehole 504 for the tool 500. To test the formation F, the tool 500 may include one or more probes 510, and the tool 500 may also include one or more outlets 512 that may be used to inject fluids within the sealed portion established by the packers 508 between the tool 500 and the formation F.

Figure 6:
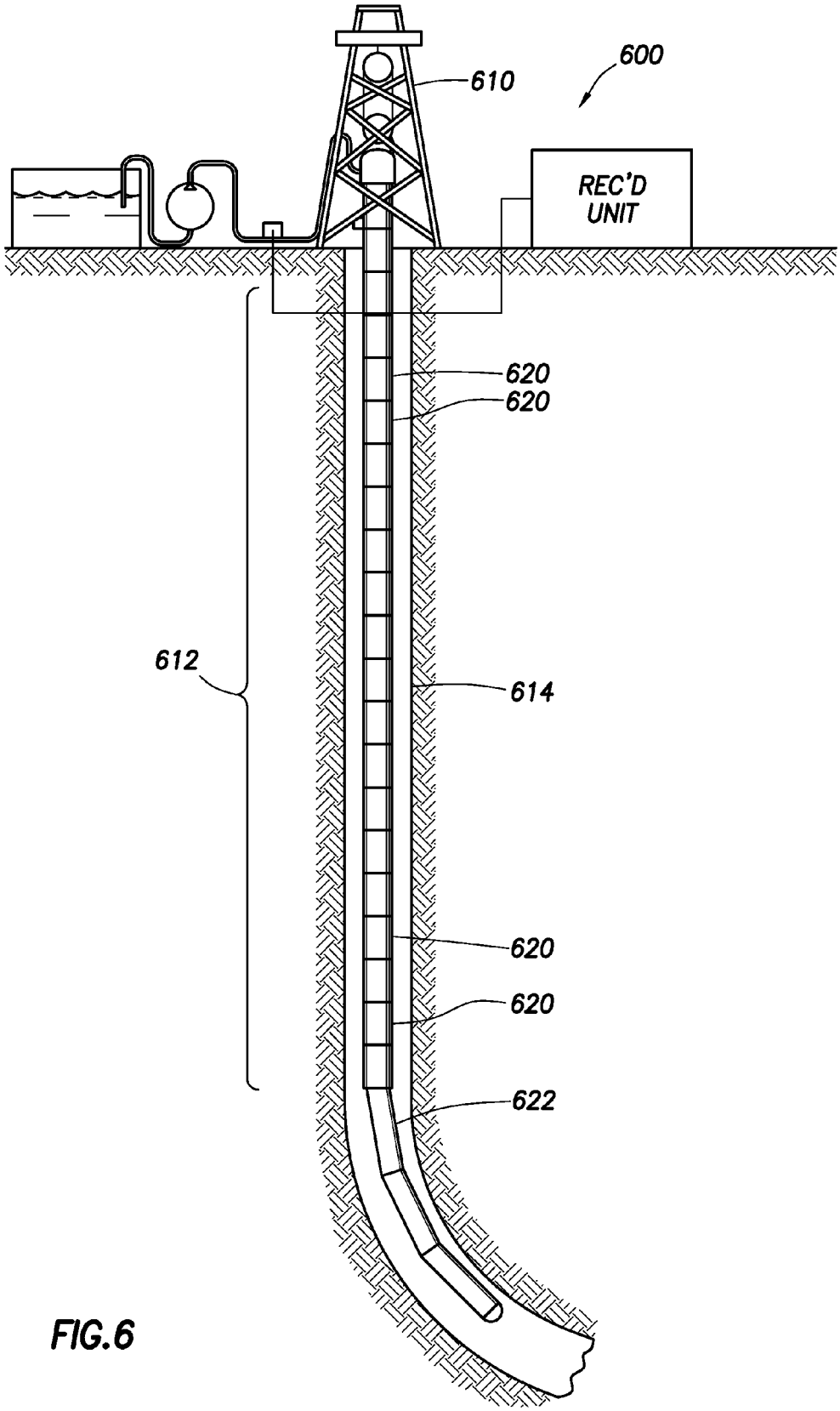
FIG. 6 is a side view of apparatus according to one or more aspects of the present disclosure.

Referring now to FIG. 6, illustrated is a side view of a wellsite 600 having a drilling rig 610 in accordance with one or more aspects of the present disclosure. A borehole 614 may be formed within a subsurface formation F, such as by using a drilling assembly, or any other method known in the art. A wired pipe string 612 may be suspended from the drilling rig 610. The wired pipe string 612 may be extended into the borehole 614 by threadably coupling multiple segments 620 (i.e., joints) of wired drill pipe together in an end-to-end fashion. The wired drill pipe segments 620 may be similar to that as described within U.S. Pat. No. 6,641,434, filed on May 31, 2002, entitled "Wired Pipe Joint with Current-Loop Inductive Couplers," and incorporated herein by reference.

Wired drill pipe may be structurally similar to that of typical drill pipe, however the wired drill pipe may additionally include a cable installed therein to enable communication through the wired drill pipe. The cable installed within the wired drill pipe may be any type of cable capable of transmitting data and/or signals therethrough, such an electrically conductive wire, a coaxial cable, an optical fiber cable, and or any other cable known in the art. The wired drill pipe may include having a form of signal coupling, such as having inductive coupling, to communicate data and/or signals between adjacent pipe segments assembled together.

The wired pipe string 612 may include one or more tools 622 and/or instruments disposed within the pipe string 612. For example, as shown in FIG. 6, a string of multiple borehole tools 622 may be coupled to a lower end of the wired pipe string 612. The tools 622 may include one or more tools used within wireline applications, may include one or more LWD tools, may include one or more formation evaluation or sampling tools, and/or may include any other tools capable of measuring a characteristic of the formation F.

The tools 622 may be connected to the wired pipe string 612 during drilling the borehole 614, or, if desired, the tools 622 may be installed after drilling the borehole 614. If installed after drilling the borehole 614, the wired pipe string 612 may be brought to the surface to install the tools 622, or, alternatively, the tools 622 may be connected or positioned within the wired pipe string 612 using other methods, such as by pumping or otherwise moving the tools 622 down the wired pipe string 612 while still within the borehole 614. The tools 622 may then be positioned within the borehole 614, as desired, through the selective movement of the wired pipe string 612, in which the tools 622 may gather measurements and data. These measurements and data from the tools 622 may then be transmitted to the surface of the borehole 614 using the cable within the wired drill pipe 612.

An apparatus, a system, and one or more methods of using an apparatus and a system, in accordance with the present disclosure, may be included within the tools and/or devices shown in FIGS. 1-6, in addition to being included within other tools and/or devices that may be disposed within a formation. The apparatus, thus, may be used to determine fluid movement in a formation. For example, the apparatus, or a system incorporating the apparatus or elements of the apparatus, may be used to pump fluid into a formation, such as a fluid having a tracer element, in which the apparatus may be used to determine the movement of the fluid within the formation. Based upon this movement of the fluid within the formation, one or more properties and/or characteristics of the formation may be determined. For example, the mobility of the fluid within the formation may be determined based upon the movement of the fluid within the formation.

An apparatus in accordance with the present disclosure may include, at least, a first packer configured to selectively engage a wall of a borehole of a formation. For example, a borehole may be formed within a formation, in which the first packer may be used to engage a wall of the borehole, such as by sealingly engage the wall of the borehole. The system may further include an outlet disposed adjacent to the first packer, in which the outlet may be configured to have a first fluid pumped therefrom into the formation. In addition to having a first fluid pumped therefrom, the outlet may additionally be configured to have a second fluid pumped therefrom into the formation. When having the first fluid and the second fluid pumped into the formation, the outlet may alternate between having the first fluid pumped therefrom and having the second fluid pumped therefrom, or the outlet may have the first fluid and the second fluid pumped simultaneously therefrom. At one moment, the first fluid may be pumped from the outlet of the apparatus, in which the second fluid may then, in addition or in alternative, be pumped from the outlet of the apparatus.

Additionally, the apparatus may have a detecting tool included therewith, in which the detecting tool may be configured to detect the first fluid within the formation. For example, the detecting tool may be disposed adjacent to the first packer of the apparatus, in which the first fluid pumped from the outlet of the apparatus may be detected by the detecting tool of the apparatus. The detecting tool may be an inducting tool. As such, the induction tool may be used to detect the first fluid within the formation, such as by having the induction tool measure a resistivity of the first fluid within the formation.

The first fluid may have a tracer element included therewith or disposed therein. When the detecting tool is used to detect the first fluid within the formation, the detecting tool may detect the tracer element of the first fluid. Accordingly, the first fluid may be brine, in which the detecting tool may be used to detect the resistivity of the brine within the formation. The second fluid may be water, for example.

Figure 7:
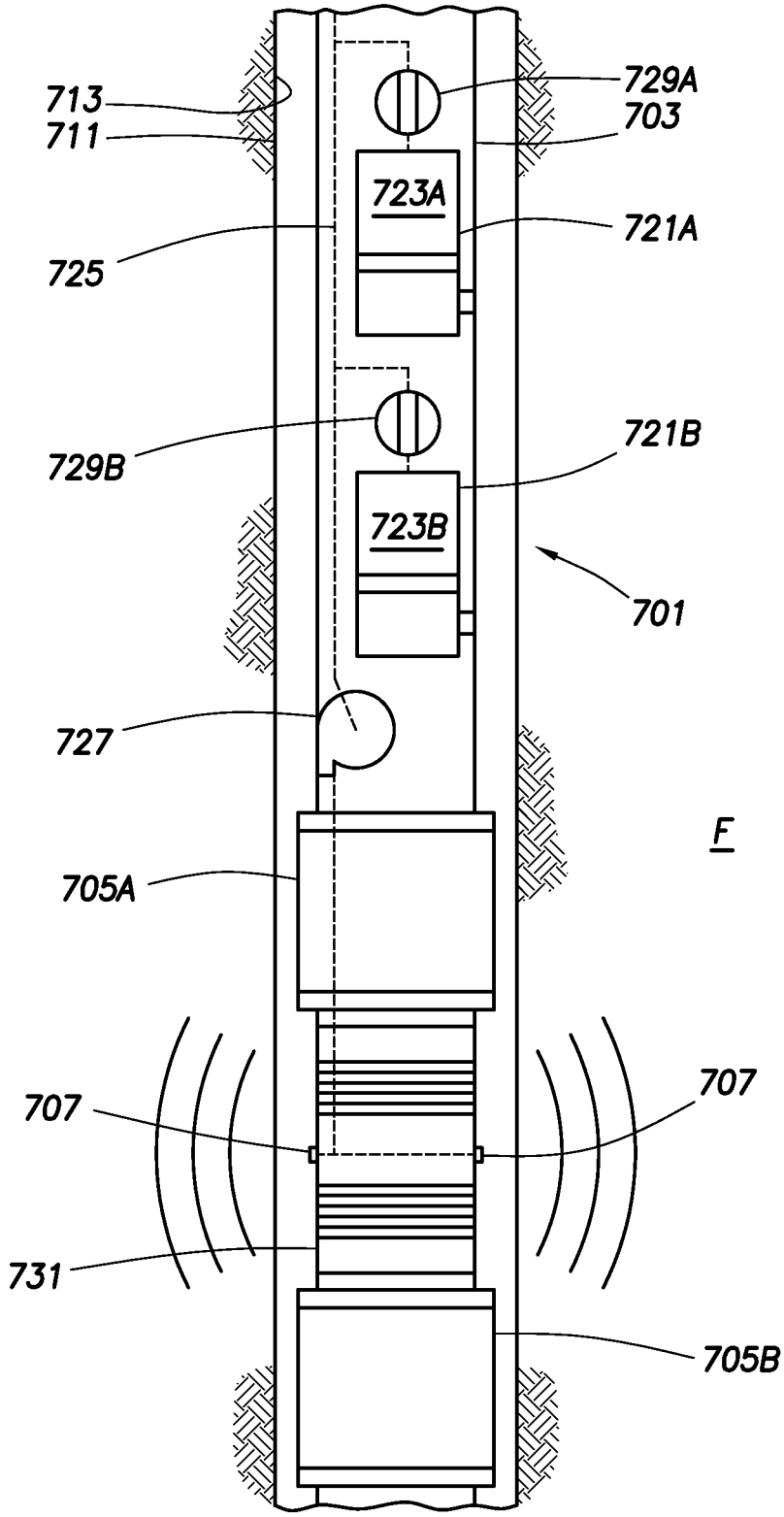
FIG. 7 is a schematic view of apparatus according to one or more aspects of the present disclosure.

Referring now to FIG. 7, illustrated is a schematic view of an apparatus 701 in accordance with one or more aspects of the present disclosure. The apparatus 701 may include a housing 703, such as a generally cylindrical shaped housing, in which the housing 703 may have an axis extending therethrough. As shown, the apparatus 701 may be disposed downhole into a borehole 711 formed within a formation F. As such, and as discussed further below, the apparatus 701 may be used to determine fluid movement in the formation F.

As shown, the apparatus 701 may include one or more packers 705, in which the packers 705 may be used to selectively engage a wall 713 of the borehole 711 of the formation F. For example, the apparatus 701 includes a first packer 705A and a second packer 705B, in which each of the packers 705A and 705B may be used to selectively engage the wall 713 of the borehole 711. Particularly, the packers 705 may be used to sealingly engage the wall 713 of the borehole 711, thereby preventing fluid from flowing across the surfaces between the wall 713 of the borehole 711 and the packers 705. As shown, as the packers 705 may be used to selectively engage the wall 713 of the borehole 711, such as when desired, the packers 705 may be activated, when desired, to engage the wall 713 of the borehole 711. One or more of the packers 705 may be inflatable, in which the packers 705 may then be inflated when desired to have the packers 705 engage the wall 713 of the borehole 711. Those having ordinary skill in the art will appreciate, however, that other structures and/or mechanisms may be used for the packers of the present disclosure such that the packers selectively engage the wall of the borehole.

The apparatus 701 may include one or more outlets included therein, in which the outlets may be used to have fluid pumped therefrom. For example, as shown, the apparatus 701 may include one or more outlets 707, such as by having one or more probes, disposed adjacent to one or more of the packers 705, in which the outlets 707 may be used to have a fluid pumped therefrom, such as to have fluid pumped into the formation F. As the apparatus 701 may include two packers 705A and 705B, the outlets 707 may be formed within the apparatus 701 and adjacent to the packers 705A and 705B such that the outlets 707 are disposed between the packers 705A and 705B. As such, as the outlets 707 have fluid pumped therefrom, the fluid may be pumped from the apparatus 707 through the outlets 707, in which the fluid may enter the borehole 711. As the packers 705 may be used to engage the wall 713 of the borehole 711, such as by sealingly engaging the wall 713 of the borehole 711, fluid may be prevented from moving across the packers 705. Fluid may enter the formation F as pressure increases from having fluid pumped out through the outlets 707.

The one or more outlets 707 may be used to have at least one fluid pumped therefrom and into the formation F. The outlets 707 may be used to have a first fluid and a second fluid pumped therefrom. For example, apparatus 701 may include one or more containers 721 formed therein, in which fluids may be disposed within the containers 721 of the apparatus 701. The containers 721 may be fluidly coupled to the outlets 707 such that fluid disposed within the containers 721 may be pumped from the containers 721 and through the outlets 707.

In FIG. 7, the apparatus 701 may include a first container 721A and a second container 721B, in which a first fluid 723A may be disposed within the first container 721A and a second fluid 723B may be disposed within the second container 721B. The containers 721A and 721B may be fluidly coupled to the outlets 707, such as by having one or more flowlines 725 within the apparatus 701 that fluidly couple the containers 721A and 721B to the outlets 707. The fluids 723A and 723B disposed within the containers 721A and 721B may be pumped from the containers 721A and 721B and through the outlets 707.

As shown, the apparatus 701 may include one or more pumps 727 included therewith, in which the pumps 727 may be used to pump the fluid 723 through the outlets 707. For example, as shown, the apparatus 701 may include a pump 727 fluidly coupled to the flowline 725 between the containers 721A and 721B and the outlets 707, thereby enabling fluid 723 to be pumped through the outlets 707. Those having ordinary skill in the art will appreciate that the pump in accordance with the present disclosure may be a hydraulic pump, an electric pump, and/or any other pump known in the art.

As discussed above, the outlets 707 may be used to have the first fluid 723A and 723B pumped therefrom and into the formation F. When having fluid pumped therefrom, the apparatus 701 may be used to selectively pump the first fluid 723A and/or the second fluid 723B through the outlets 707. For example, as shown, one or more valves 729 may be included within the apparatus 701, in which the valves 729 may be selectively opened and closed to selectively pump the first fluid 723A and/or the second fluid 723B through the outlets 707. Accordingly, a first valve 729A may be fluidly coupled to the first container 721A, in which the first valve 729A may be selectively opened and closed to have the first fluid 723A pumped from the first container 721A and through the outlets 707, and a second valve 729B may be fluidly coupled to the second container 721B, in which the second valve 729B may be selectively opened and closed to have the second fluid 723B pumped from the second container 721B and through the outlets 707.

As mentioned, when having fluid pumped from the outlets 707, the apparatus 701 may be used to selectively pump the first fluid 723A and/or the second fluid 723B through the outlets 707. As such, in one arrangement, the outlets 707 may alternate between having the first fluid 723A pumped therefrom and having the second fluid 723B pumped therefrom. In another arrangement, when having fluid pumped therefrom, the outlets 707 may have the first fluid 723A and the second fluid 723B simultaneously pumped therefrom. The fluids 723A and 723B may be pumped through the outlets 707 to have a desired ratio of the first fluid 723A pumped through the outlets 707 to the second fluid 723B pumped through the outlets 707. The first fluid 723A may be pumped from the one or more outlets 707 of the apparatus 701, in which the second fluid 723B may then, in addition or in alternative, be pumped from the outlets 707 of the apparatus 701. Accordingly, the valves 729A and 729B may be selectively operated (e.g., opened and closed), as desired, to have the first fluid 723A and/or the second fluid 723B pumped through the outlets 707.

Referring still to FIG. 7, the apparatus 701 may include a detecting tool 731, such as by having a detecting tool 731 disposed therein and/or included therewith. The detecting tool 731 may be used to detect one or more fluids within the formation F. For example, as discussed above, the apparatus 701 may be used to pump the first fluid 723A and the second fluid 723B into the formation F. As such, the detecting tool 731 may be used to detect at least one of the fluids 723A and 723B in the formation F. When only one fluid is pumped into the formation F, the detecting tool 731 may be used to detect the one fluid pumped into the formation F.

In addition to the detecting tool 731 being used to detect the first fluid 723A within the formation F, the detecting tool 731 may be used to measure one or more properties of the first fluid 723A pumped within the formation F. For example, the detecting tool 731 may be used to detect/measure a property of the first fluid 731, such as a density, viscosity, temperature, pressure, resistivity, gas content, and/or any other property of the first fluid 731 pumped into the formation F.

The detecting tool 731 may include an induction tool, in which the induction tool may be used to measure a resistivity of first fluid disposed within the formation. For example, the Rt Scanner triaxial induction tool, provided by Schlumberger, may be used as an induction tool in accordance with the present disclosure, in which the induction tool may be used to measure resistivity within a formation at different depths-of-investigation in three orthogonal directions (i.e., x, y, and z directions). A transmitter may be included within the induction tool, in which the transmitter may transmit energy, such as electromagnetic energy, into the formation in up to three orthogonal directions. The induction tool may include one or more receivers, such as a main receiver and a balancing receiver, to receive and measure the effects of the energy transmitted into the formation. The induction tool may be used to measure the resistivity within the formation at various ranges and depths-of-investigation.

In accordance with the present disclosure, one or more of the fluids pumped into the formation may include one or more tracer elements therein. By having a tracer element therein, the detecting tool may be used to detect the tracer element within the fluid. In addition, when the detecting tool is used to measure one or more properties of the fluid, the detecting tool may be used to measure the quantity and/or location of the tracer element within the fluid. If the detecting tool is an induction tool, one or more of the fluids pumped into the formation may include a tracer element to increase and/or decrease the resistivity detected/measured within the formation.

For example, the first fluid pumped into the formation may have a relatively high-salinity content, such as brine (and/or any other relatively high-salinity fluid or material), in which the brine may alter the resistivity of the formation by being pumped therein. Particularly, by pumping a relatively high-salinity content fluid, such as brine, into the formation, the resistivity within the formation may decrease. When a relatively high-salinity content fluid is pumped into the formation as a first fluid, a relatively low-salinity content fluid, such as water, may also be pumped into the formation, such as water being used as the second fluid. The first fluid pumped into the formation may be contrasted by the second fluid pumped into the formation, thereby providing a variable response of the measured resistivity within the formation by the induction tool based upon the amount and locations of the fluids pumped into the formation.

Accordingly, an apparatus in accordance with the present disclosure may be used to determine a movement of fluid within a formation, and thereby determine one or more properties and/or characteristics of the formation based upon the movement of the fluid. For example, fluid may be pumped into the formation by the apparatus, such as a first fluid having a tracer element therein, in which the fluid may be observed (e.g., detected and/or measured) as the fluid travels through the formation. Particularly, as the first fluid is pumped into the formation, the detecting element may be used to detect the first fluid within the formation, and the movement of the first fluid within the formation may be determined based upon the detection of the first fluid with the detecting tool. When an induction tool is used as the detecting tool, brine, for example, may then be pumped into the formation, and the resistivity may be measured by the induction tool, as the brine, when traveling through the formation, may be used to selectively decrease the resistivity measured within the formation by the induction tool.

Based upon the determined movement of the fluid within the formation, one or more properties and/or characteristics of the formation may be determined. For example, the porosity of a formation may be determined based upon the movement of the detected fluid within the formation, the density of a formation may be determined based upon the movement of the detected fluid within the formation, in addition to many other properties and/or characteristics may be determined based upon the movement of the detected fluid within the formation. This may enable one to determine a shape, configuration, and/or fluid mobility for a formation, such as determine horizontal and/or vertical boundaries within a formation, in addition to other discontinuities present within the formation.

As discussed above, multiple fluids may be pumped into the formation using an apparatus in accordance with the present disclosure. As such, in addition to pumping a first fluid into the formation, the apparatus may be used to pump a second fluid (and/or three or more fluids) into the formation. The apparatus may alternate between having the first fluid pumped therefrom and having the second fluid pumped therefrom. The apparatus may be used to pump the first fluid into the formation for a selected amount of time, and then the apparatus may be used to pump the second fluid into the formation for a selected amount of time. For example, the first fluid and/or the second fluid may be pumped into the formation for a time interval, such as a predetermined or preselected time interval. Particularly, the apparatus may be used to pump the first fluid having the tracer element therein into the formation for a selected amount of time, and then may be used to pump the second fluid not having a tracer element therein into the formation for a selected amount of time.

By alternating between pumping the first fluid into the formation and pumping the second fluid into the formation, the movement of the fluids within the formation may be more easily obtained. For example, when only pumping and detecting the first fluid within the formation, only a single "wave" of the first fluid may be detected by the detecting tool as the first fluid propagates and travels through the formation. However, by alternating between pumping and detecting the first fluid and the second fluid within the formation, multiple "waves" of the first fluid may be detected by the detecting tool as the first fluid propagates and travels through the formation.

For example, when pumping brine as the first fluid into the formation and using an induction tool to measure the resistivity within the formation, and thereby detect the first fluid in the formation based upon the resistivity, the induction tool may be able to detect the multiple waves of brine within the formation as the apparatus alternates between pumping brine into the formation and pumping the second fluid, such as water, into the formation. Accordingly, this may enable one to more easily determine the movement of the first fluid within the formation based upon the detection of the first fluid (e.g., brine) within the formation. By alternating the pumping of the first fluid and the second fluid within the formation, this may provide one with more information to determine one or more properties and/or characteristics of the formation, such as horizontal and/or vertical boundaries within a formation, in addition to other discontinuities present within the formation.

When alternating between pumping the first fluid into the formation and pumping the second fluid into the formation, the first fluid and the second fluid may be pumped into the formation using a pre-determined sequence. For example, a sequence may be pre-determined such that the first fluid may be pumped into the formation for a pre-determined time and/or for a pre-determined amount and the second fluid may also be pumped into the formation for a pre-determined time and/or for a pre-determined amount. Accordingly, the first fluid and the second fluid may be pumped into the formation using a binary sequence and then detected using the detecting tool. The fluids may be pumped into the formation using a pseudo-random binary sequence, such as using one or more "M-Sequences" when pumping the fluids into the formation. Using one or more particular sequences, such as a M-Sequences, the signal-to-noise ratio may be improved by reducing the amount of noise received by the detection tool. An example of one or more sequences that may be used in accordance with the present disclosure is also described within U.S. Patent Application No. 2007/0061093, filed on Aug. 28, 2006, entitled "Time-Of-Flight Stochastic Correlation Measurements," which is assigned to the assignee of the present disclosure, and is incorporated herein by reference in its entirety.

In addition to alternating between pumping the first fluid into the formation and pumping the second fluid into the formation, the apparatus may be used to simultaneously pump the first fluid and the second fluid into the formation. The first and the second fluids may be pumped from the apparatus to have a desired ratio of the first fluid to the second fluid. Accordingly, at one moment, the first fluid may be pumped from the outlet of the apparatus, in which the second fluid may then, in addition or in alternative, be pumped from the outlet of the apparatus.

As discussed above, the present disclosure may contemplate having a predetermined time interval for pumping a first fluid and/or a second fluid within a formation. Those having ordinary skill in the art will appreciate that the present disclosure contemplates varying one or more characteristics and/or properties of a fluid that is pumped within a formation. For example, the present disclosure may use a preselected and/or predetermined time interval when pumping the fluid, may use a preselected and/or predetermined pressure when pumping the fluid, may use a preselected and/or predetermined volume when pumping the fluid, may use a preselected and/or predetermined fluid flow when pumping the fluid, may use a preselected and/or predetermined fluid composition when pumping the fluid, and/or may use other preselected and/or predetermined characteristics when pumping the fluid. One or more of these characteristics of the fluid may vary with time when being pump into the formation. For example, the pressure, volume, fluid flow, fluid composition, and/or other characteristics may vary with time as being pumped into the formation.

Accordingly, a detecting tool may be used to detect one or more of the characteristics of the fluid when pumped into the formation. For example, as the fluid pumped into the formation interacts with the formation, the detecting tool may be used to detect one or more characteristics of the formation, in which one or more characteristics of the fluid may be predetermined and/or varied to enable the detecting tool to detect one or more characteristics of the formation. A method of the present disclosure, as such, may include the fluid pumped into the formation interacting with the formation, the pumped fluid then being used to produce a signal (e.g., convolution) that may be detected by the detecting device, in which the detecting device may be used to process (e.g., deconvolution) the signal of the fluid to determine characteristics of the formation.

Those having ordinary skill in the art will appreciate that an apparatus and/or a system in accordance with the present disclosure may have other structures and/or arrangements as compared to that shown in FIG. 7. For example, as shown in FIG. 7, the apparatus 701 includes the first container 721A having the first fluid 723A contained therein and the second container 721B having the second fluid 723B contained therein. However, instead of having the first fluid 723A and/or the second fluid 723B disposed within the apparatus 701, one or more of the fluids may be pumped from the surface of the formation F and through the apparatus 701. The outlet 707 may be used to pump the first fluid 723A and the second fluid 723B therefrom, in which the first fluid 723A may be pumped through the apparatus 701 from the surface and the second fluid 723B may be pumped from a container disposed within the apparatus 701. Rather than by having all of the elements included within one apparatus, the elements of the apparatus shown in FIG. 7 may be distributed amongst multiple apparatuses within a system. For example, the detecting tool may be included within one apparatus that may be disposed downhole, and the inflatable packers and/or outlets for pumping fluid into the formation may be included within another apparatus that may be disposed downhole.

As discussed above, one or more of the fluids used in accordance with the present disclosure may include a tracer element, in which the detecting tool may be used to detect the tracer element within the fluid. As discussed above, one of the fluids used may be brine, in which an induction tool, being used as the detecting tool, may be used to detect the resistivity of the brine within the formation. However, those having ordinary skill in the art will appreciate that the present disclosure is not so limited, as other tracer elements and fluids may be used without departing from the scope of the present disclosure.

For example, the tracer element may be a radioactive element, in which the radioactive element may be detected by a detecting tool within the formation. Other tracer elements and/or other fluids may be used, in which the detecting tool may be used to detect one or more properties and/or characteristics of the fluid within the formation, such as by detecting and/or measuring viscosity, temperature, pressure, gas content (e.g., gas volume and/or gas type within the formation). A detecting tool may be able to detect, such as by measuring and/or detecting, one or more properties of a fluid having a particular chemical composition, having a dye disposed therein, having a mixture of various fluids (e.g., oil and water mixture), and/or having a mixture of phases therein (e.g., solid, gas, and/or liquid). As such, each of these properties, characteristics, and/or elements, in addition to other properties, characteristics, or elements, may be used by a detecting tool to detect a fluid within a formation. Accordingly, depending on the tracer element used within the fluid within an apparatus of the present disclosure, an appropriate detecting tool for measuring the tracer element may also be used within an apparatus of the present disclosure. For example, when the tracer element is a radioactive element, a radioactive element detecting tool may correspondingly be used.

Additionally or alternatively, the fluid pumped into the formation may chemically react and/or interact with the formation, such as by having one or more properties and/or characteristics of the fluid and/or the formation change when the fluid is pumped into the formation. As fluid is pumped into the formation, the properties of the fluid and/or the formation, such as the chemical properties of the fluid, may change as the fluid interacts with the formation. For example, if the fluid pumped into the formation is a doping material, a nuclear magnetic resonance (NMR) detecting tool may be used to detect and/or measure the response of hydrogen nuclei on the surface of rocks within the formation. This response of the hydrogen nuclei with the rocks of the formation may also change over time, which may be detected by the NMR detecting tool. Additionally, fluid may also be pumped into the formation to interact with fluid already present within the formation. For example, brine may be present within the formation, in which fluid may be pumped into the formation to interact with the brine to change the conductivity of the fluid within the formation, which may be detected by an induction tool disposed within a borehole within the formation.

Figure 8:
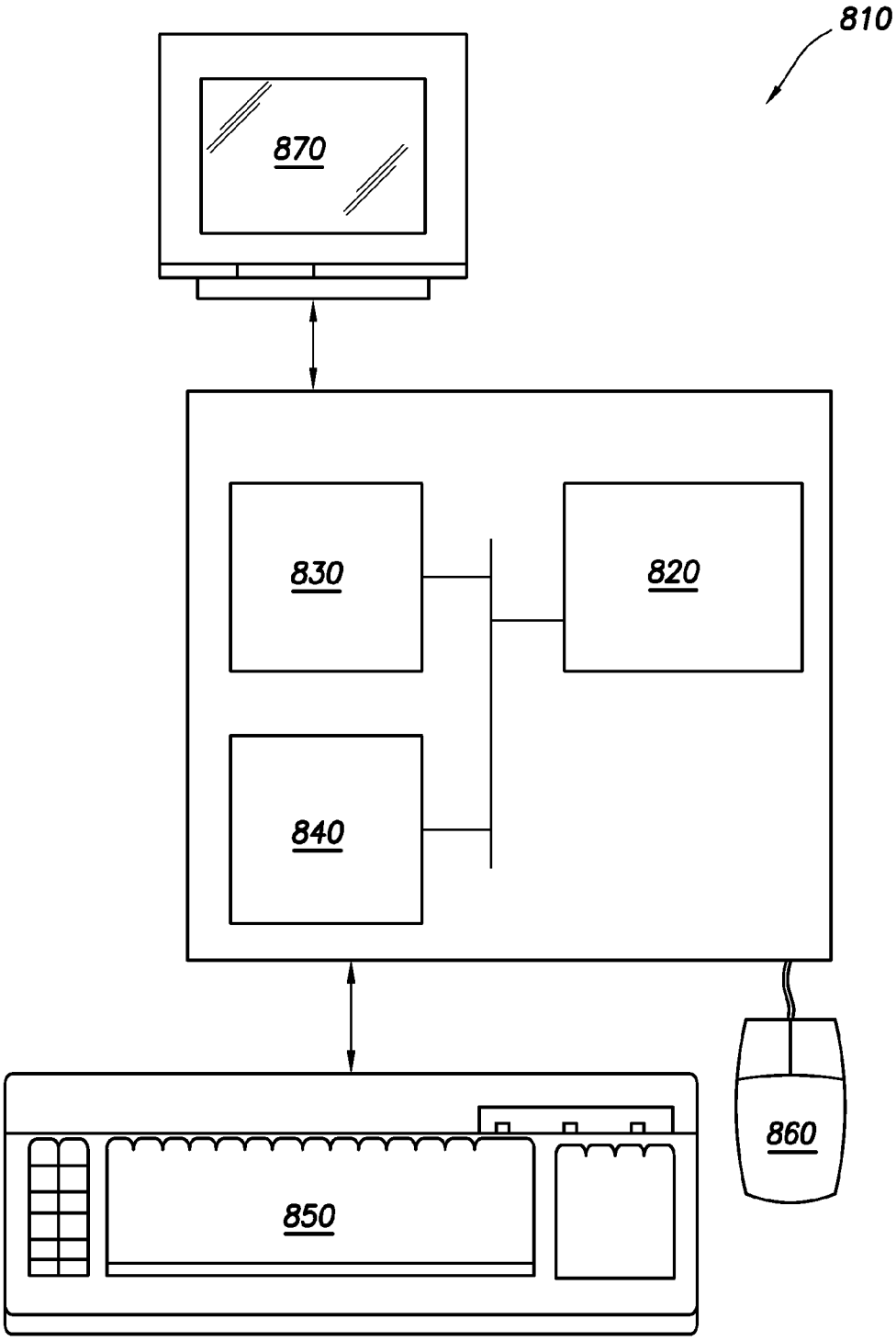
FIG. 8 is a schematic view of apparatus according to one or more aspects of the present disclosure.

Aspects of the present disclosure, such as detecting a fluid within a formation, determining a movement of the fluid within the formation, and determining one of a property and a characteristic of the formation, may be implemented on any type of computer regardless of the platform being used. For example, as shown in FIG. 8, a networked computer system 810 that may be used within the present disclosure may include a processor 820, associated memory 830, a storage device 840, and numerous other elements and functionalities typical of today's computers (not shown). The networked computer system 810 may also include input means, such as a keyboard 850 and a mouse 860, and output means, such as a monitor 870. The networked computer system 810 is connected to a local area network (LAN) or a wide area network (e.g., the Internet) (not shown) via a network interface connection (not shown). Those skilled in the art will appreciate that these input and output means may take many other forms. Additionally, the computer system may not be connected to a network. Those skilled in the art will appreciate that one or more elements of aforementioned computer 810 may be located at a remote location and connected to the other elements over a network. A computer system, such as the networked computer system 810, and/or any other computer system known in the art may be used, such as by having a computer system coupled to and/or included within an apparatus of the present disclosure.

The present disclosure may provide for one or more of the following advantages. An apparatus, a system, and/or a method in accordance with the present disclosure may be included within one or more of the tools and/or devices shown in FIGS. 1-6, in addition to being included within other tools and/or devices that may be disposed downhole within a formation. An apparatus, a system, and/or a method in accordance with the present disclosure may be able to determine fluid movement within a formation. This may enable one or more properties and/or characteristics of the formation to be determined based upon the movement of the fluid within the formation.

In view of all of the above and the figures, those skilled in the art should readily recognize that the present disclosure introduces an apparatus comprising: a first packer configured to selectively engage a wall of a borehole extending into a subterranean formation; a detecting tool disposed adjacent to the first packer; and an outlet disposed adjacent to the first packer; wherein the outlet is configured to have a first fluid and a second fluid pumped therefrom and into the formation; and wherein the detecting tool is configured to detect the first fluid pumped into the formation. The apparatus may further comprise a second packer configured to selectively engage the borehole wall, wherein the outlet is disposed between the first and second packers. The first fluid may comprise a tracer element, and the detecting tool may be configured to detect the tracer element of the first fluid. The outlet may be configured to alternate between pumping the first fluid and the second fluid therefrom and into the formation. The apparatus may further comprise: a first container fluidly coupled to the outlet, wherein at least a portion of the first fluid is disposed within the first container; and a first valve fluidly coupled between the first container and the outlet. The apparatus may further comprise: a second container fluidly coupled to the outlet, wherein at least a portion of the second fluid is disposed within the second container; and a second valve fluidly coupled between the second container and the outlet. The apparatus may further comprise at least one pump fluidly coupled between the outlet and at least one of the first container and the second container. The first fluid may comprise brine, and the second fluid may comprise water. The detecting tool may comprise an induction tool. The induction tool may be configured to measure a resistivity of the first fluid within the formation.

The present disclosure also introduces a method comprising: disposing a detecting tool into a borehole formed within a formation; pumping a first fluid into the formation; and detecting the first fluid within the formation with the detecting tool. The method may further comprise determining a movement of the first fluid within the formation based upon the detection of the first fluid within the formation. The method may further comprise determining one of a property and a characteristic of the formation based upon the determined movement. Detecting the first fluid within the formation with the detecting tool may comprise measuring a property of the first fluid within the formation with the detecting tool. The detecting tool may comprise an induction tool, and measuring the property of the first fluid within the formation with the detecting tool may comprise measuring a resistivity of the first fluid within the formation with the induction tool. The first fluid may comprise a tracer element, and the detecting the first fluid within the formation with the detecting tool may comprises detecting the tracer element of the first fluid within the formation with the detecting tool. The method may further comprise pumping a second fluid into the formation. The method may further comprise alternating between pumping the first fluid into the formation and pumping the second fluid into the formation. Alternating between pumping the first fluid and the second fluid may be performed using a pre-determined sequence. The method may further comprise engaging a wall of the borehole with a first packer, wherein the first fluid is pumped from an outlet disposed adjacent to the first packer. The method may further comprise engaging the wall of the borehole with a second packer, wherein the outlet is disposed between the first packer and the second packer. The method may further comprise outputting the one of the property and the characteristic of the formation, wherein the outputting comprises at least one of: graphically displaying the one of the property and the characteristic of the formation; printing the one of the property and the characteristic of the formation; and storing or transferring to computer readable media the one of the property and the characteristic of the formation.

The foregoing outlines feature several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a first packer configured to selectively engage a wall of a borehole extending into a subterranean formation;

a detecting tool disposed adjacent to the first packer to transmit energy into the subterranean formation;

an outlet disposed adjacent to the first packer;

a pump to variably inject a first fluid having a tracer element and a second fluid without the tracer element through the outlet into the subterranean formation; and a detecting tool disposed adjacent to the first packer to transmit energy into the subterranean formation to detect movement of the first fluid through the formation based on the variable injection of the first fluid and the second fluid into the subterranean formation.

2. The apparatus of claim 1 further comprising a second packer configured to selectively engage the borehole wall, wherein the outlet is disposed between the first and second packers.

3. The apparatus of claim 1 wherein the detecting tool is configured to detect the tracer element of the first fluid.

4. The apparatus of claim 1 wherein the pump is configured to alternately inject the first fluid and the second fluid into the formation.

5. The apparatus of claim 1 further comprising:

a first container fluidly coupled to the outlet, wherein at least a portion of the first fluid is disposed within the first container; and a first valve fluidly coupled between the first container and the outlet.

6. The apparatus of claim 5 further comprising:

a second container fluidly coupled to the outlet, wherein at least a portion of the second fluid is disposed within the second container; and a second valve fluidly coupled between the second container and the outlet.

7. The apparatus of claim 6 further comprising at least one pump fluidly coupled between the outlet and at least one of the first container and the second container.

8. The apparatus of claim 1 wherein the first fluid comprises brine, and wherein the second fluid comprises water.

9. The apparatus of claim 1 wherein the detecting tool comprises an induction tool.

10. The apparatus of claim 9 wherein the induction tool is configured to measure a resistivity of the first fluid within the formation.

11. A method, comprising:

disposing a detecting tool into a borehole formed within a formation;

variably pumping a first fluid having a tracer element and a second fluid without the tracer element into the formation; and transmitting energy into the formation, via the detecting tool, to detect movement of the first fluid through the formation based on the variable injection of the first fluid and the second fluid into the formation.

12. The method of claim 11 further comprising determining the movement of the first fluid within the formation based upon the detection of the first fluid within the formation.

13. The method of claim 12 further comprising determining one of a property and a characteristic of the formation based upon the determined movement.

14. The method of claim 11 further comprising measuring a property of the first fluid within the formation with the detecting tool.

15. The method of claim 14 wherein the detecting tool comprises an induction tool, and wherein measuring the property of the first fluid within the formation with the detecting tool comprises measuring a resistivity of the first fluid within the formation with the induction tool.

16. The method of claim 11 wherein transmitting energy into the formation comprises detecting the tracer element of the first fluid within the formation with the detecting tool.

17. The method of claim 11 wherein variably pumping comprises alternating between pumping the first fluid into the formation and pumping the second fluid into the formation.

18. The method of claim 17 wherein alternating between pumping the first fluid and the second fluid is performed using a pre-determined sequence.

19. The method of claim 11 further comprising engaging a wall of the borehole with a first packer, wherein the first fluid is pumped from an outlet disposed adjacent to the first packer.

* * * * *